United States Patent [19]

Endriz

[11] 4,115,724

[45] Sep. 19, 1978

[54] ELECTRON BEAM OSCILLATION COMPENSATION METHOD

[75] Inventor: John Guiry Endriz, Cupertino, Calif.

[73] Assignee: RCA Corporation, New York, N.Y.

[21] Appl. No.: 827,688

[22] Filed: Aug. 25, 1977

[51] Int. Cl.[2] ..... H05B 37/00; H05B 39/00; H05B 41/00

[52] U.S. Cl. ..... 315/169 TV; 315/366; 313/422

[58] Field of Search ..... 313/422, 425, 427, 437, 313/400; 315/169, 366, 370; 250/396 R

[56] References Cited

U.S. PATENT DOCUMENTS

| | | | |
|---|---|---|---|
| 4,028,582 | 6/1977 | Anderson et al. | 313/422 |
| 4,031,427 | 6/1977 | Stanley | 313/422 |
| 4,069,439 | 1/1978 | Anderson | 313/422 |
| 4,076,994 | 2/1978 | Anderson | 313/422 |

*Primary Examiner*—Alfred E. Smith
*Assistant Examiner*—Robert E. Wise
*Attorney, Agent, or Firm*—E. M. Whitacre; G. H. Bruestle; G. E. Haas

[57] ABSTRACT

The effects of oscillations of an electron beam traveling down a beam guide may be cancelled out by periodic switching of the electrical fields which confine the electron beam in the guide. The changing of the electrical fields periodically alters the phase of the electron beam so as to produce a net phase cancellation over a period of time.

9 Claims, 5 Drawing Figures

ELECTRON BEAM OSCILLATION COMPENSATION METHOD

BACKGROUND OF THE INVENTION

The present invention relates to electron beam guides such as those used in image display devices and more particularly to a method for compensating for electron beam oscillations within such guides.

Recently, flat image display devices have been suggested utilizing a plurality of electron beam guides to direct electron beams to various positions on a cathodoluminescent screen. One type of these devices is described in copending Patent Application Ser. No. 671,358, now U.S. Pat. No. 4,088,920, filed on Mar. 29, 1976 by W. W. Siekanowicz et al. entitled "Flat Display Device With Beam Guide." The electron beam guide in these devices comprises several apertured plates which are biased so as to establish an electrical field balance between two of the adjacent parallel plates. At the midpoint between the two adjacent plates, the electrical fields are symmetrical looking toward each of the plates. If an electron beam is injected between the two adjacent plates, the balance of electrical field confines the electron beam and guides it in a path parallel to each of the plates. However, if the beam is injected slightly off axis so that its path is not coplanar with the geometrical center between the two adjacent plates, the beam will oscillate above and below the geometrical center. Due to these oscillations, the extraction angle of the electron beam will vary at points where the beam is extracted from the guide and directed toward the screen. This variation in extraction angle at the extraction points produces a shift in the landing position of the electron beam on the cathodoluminescent screen. The deviation in landing position varies in magnitude as the beam is scanned across the screen, depending upon the phase angle of the electron beam oscillations at the various extraction points. Such deviations from nominal landing position, produce brightness variations of light emitted from the phosphor stripes or dots on the cathodoluminescent screen. It is highly desirable in such display devices that the brightness of the cathodoluminescent screen be as uniform as possible over the entire viewing area.

SUMMARY OF THE INVENTION

A method for compensating for electron beam oscillation in an electron beam guide comprises alternately switching the electrical fields within the guide to alter the phase of the electron beam oscillations so that said oscillations will tend to cancel one another over a period of time.

DETAILED DESCRIPTION OF THE PRESENT INVENTION

Figure 1:
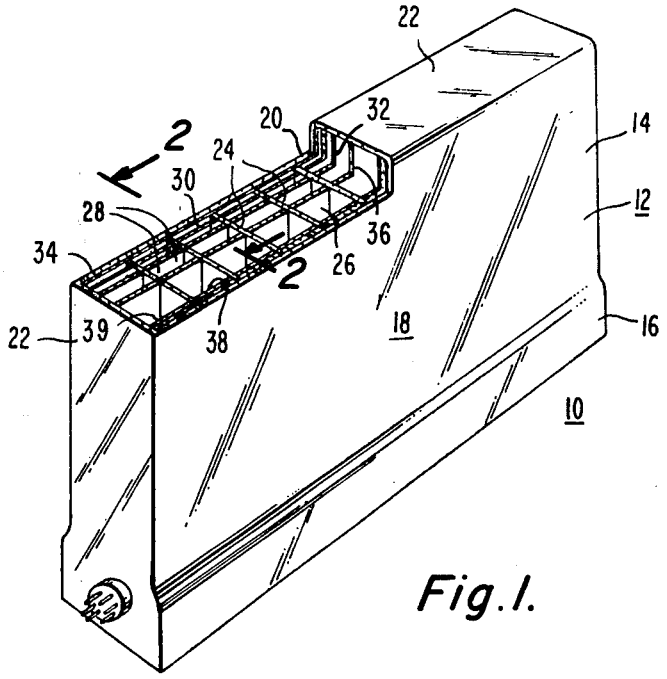
FIG. 1 is a partially cut away perspective view of an image display device in which the present method is used.

With initial reference to FIG. 1, a flat panel image display device, generally designated as 10, comprises an evacuated envelope 12, typically of glass, having a display section 14 and an electron gun section 16. The display envelope 12 comprises a rectangular front wall 18 and a rectangular back wall 20 in a spaced parallel relation connected by four sidewalls 22. A plurality of parallel support walls 24 are secured between the front wall 18 and the back wall 20 so as to provide the desired internal support on the device against external atmospheric pressure. The support walls 24 also divide the display device interior into a plurality of channels 26, each containing a plurality of electron beam guides 28. The beam guides comprise two grid electrode plates 30 and 32 in a spaced parallel relationship with respect to one another and to the rear wall 20. Each of the grid plates 30 and 32 has a plurality of apertures therethrough arranged in columns so as to define a separate beam guide 28. A plurality of extraction electrodes 34 are on the interior surface of the rear wall 20 in the form of stripes extending transversely across the channels 26. A focus electrode grid 36 extends parallel with respect to the guide grid plates 30 and 32 between the second grid plate 32 and the front wall 18. On the interior surface of the front wall 18 is a cathodoluminescent screen 38 composed of conventional cathodoluminescent phosphors similar to those presently used in cathode ray tubes. An anode electrode 39 extends over the screen 38.

The gun section 16 is an extension of the display section 14 and extends along one set of adjacent ends of the channels 26. The gun section 16 may be of any suitable shape to enclose the particular gun structure contained therein. The electron gun structure contained in the gun section may be of any well known construction suitable for selectively directing beams of electrons along each of the channels 26. For example, the gun structure may comprise a plurality of individual guns mounted at the ends of the channels 26 for directing separate beams of electrons along the channels. Alternatively, the gun structure may include a line cathode extending along the gun section 16 across the ends of the channels 26 and adapted to selectively direct individual beams of electrons along the channels. A gun structure of the line type is described in U.S. Patent Application Ser. No. 784,365 filed on Apr. 4, 1977 by R. A. Gange entitled "Cathode Structure and Method of Operating the Same". For the purposes of the description of the embodiment herein, the gun section includes a line cathode.

Figure 2:
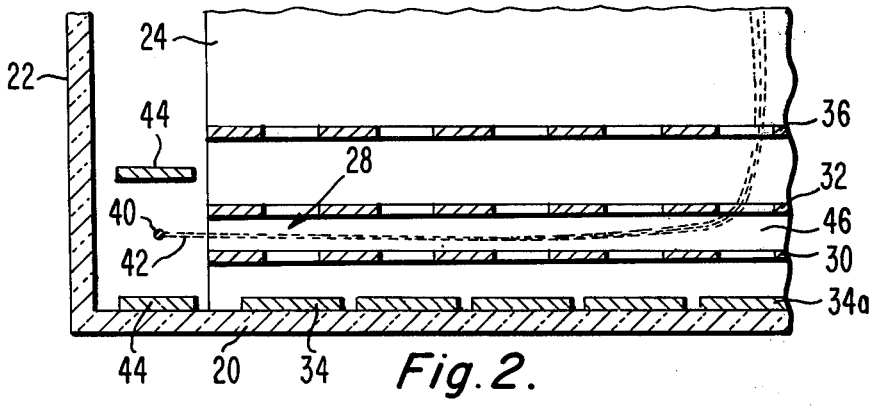
FIG. 2 is a sectional view taken along line 2—2 of FIG. 1.

As shown in FIG. 2, the line cathode 40 emits an electron beam 42 which is injected into the electron beam guide 28 between the two grid electrode plates 30 and 32. Two gun electrodes 44 insure proper injection of the electron beam 42. The biasing of the extraction electrode 34, grid plates 30 and 32, focus grid 36 and the anode 39 (FIG. 1) establish electrical fields within the guide which confine the electron beam in its path between the two grid plates 30 and 32 as described in detail in copending U.S. Patent Application Ser. No. 671,358, now U.S. Pat. No. 4,088,920. For example, in a basic guide 28 the first grid 30 is spaced about 0.5 mm from the extraction electrodes 34 and the second grid 32 is about 1.3 mm from the first grid 30. In this configuration, the voltage on the first and second grids 30 and 32 may be 50 volts. The extraction pads 34 may be biased normally to 300 volts. The voltage on the guide grids 30 and 32 may be increased to about 60 volts to alter the phase of the beam. Alternately the bias on the extraction electrodes 34 may be changed by 50 volts for phasing the beam. Specifically, the electrical fields between the two grid plates 30 and 32 are balanced so that at the midpoint between the two grid plates the electrical field looking toward one grid plate is identical to the electrical field looking toward the other grid plate. The potential axis of symmetry coincides with the geometrical center between the two grid plates 30 and 32. During the operation of the display device 10, the electron beam continues to travel through the beam guide 28 until it reaches a position 46 adjacent to an extraction electrode 34*a* which is negatively biased in order to repel the electron beam out of the guide through a set of apertures toward the cathodoluminescent screen. The beam impacting the screen displays a picture element of the image thereon.

As noted previously, any injection of the electron beam into the guide off the geometrical axis of the guide or any misalignment of the two grids 30 and 32 will cause the beam 42 to oscillate about the geometrical axis of the guide. As the extraction point 46 moves with the progressive biasing of different extraction electrodes 34, the phase of the electron beam oscillations at these different extraction points varies. This variation in beam phase at the extraction points produces landing position errors at the screen which in turn result in brightness variations across the surface of the cathodoluminescent screen. In the embodiment of FIG. 2, the landing beam errors are compensated for by switching the bias voltage on the two guide grids 30 and 32, or alternatively on the extraction electrodes 34 and the focus grid 36, between at least two levels. The change in bias voltage on the guide grids 30 and 32 changes the magnitude of the electrical field within the guide 28 while maintaining the field symmetry about the geometrical center of the guide. The varying fields in the guide 28 change the wavelength of the beam oscillation as it travels down the guide as is shown by the two beam trajectories 48 and 50 in FIG. 3. The amplitude of the oscillations and periodicity is exaggerated in FIG. 3 for illustrative purposes. The beams originating at the cathode 40 will be in phase at that point regardless of the particular field strength caused by altering the bias of the guide grids 30 and 32. Therefore, the phase of the beams 48 and 50 will cancel; i.e., be 180° out of phase at a finite number of points 54 spaced a distance 2X from one another along the guide length. At points in between where the beams are not 180° out of phase, such as point 56, only partial compensation for the phase differences will occur.

During the display of an image on the screen of the device, the voltage on the guide grids 30 and 32 is changed at a periodic interval. For example, the voltages may be changed with alternate frames of the display. With this switching, the beam landing errors at each picture element on the screen change every frame interval. Therefore, no two successive frames have the same brightness variation pattern due to the variation in the beam landing position and the relatively slow speed of the human eye will not perceive a fixed pattern of brightness variation on the screen. The brightness variations will be compensated for every two frames. Alternately, the voltages may be switched at the field rate of the display. In yet another switching scheme, the voltages may be switched at a relatively high rate such that one beam trajectory is used for half of a picture element dwell time and the other beam trajectory is used for the other half of the element dwell time. This faster switching will reduce any possible perception of the image brightness variation by the human eye.

Figure 3:
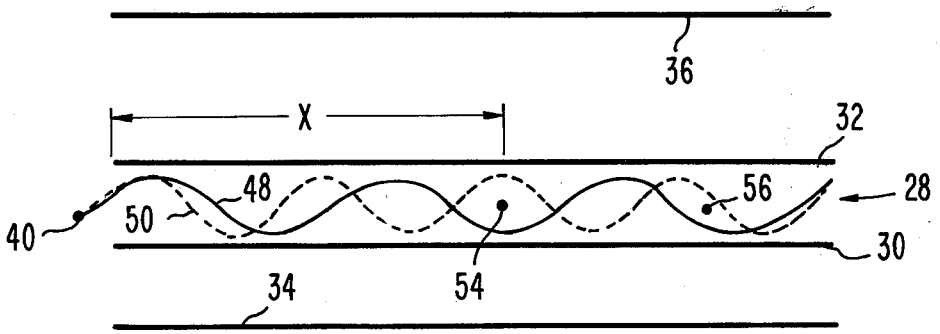
FIG. 3 is a diagrammatical representation of electron beam flow in the section of FIG. 2.

Since the phases in FIG. 3 cancel only at certain points 54, the embodiment only partially compensates for the brightness variations due to the variations in phase angle at the extraction points. However, the partial compensation is preferable to a system which does not incorporate any compensation for the phase angle difference. Alternately, the voltage on the two grid guides 30 and 32 may be continuously varied to continuously change the trajectory wavelength. This continuous field variation causes the point of total compensation 54 to travel down the guide from one extraction point to another so that there is total compensation at each point when the beam is extracted from the guide. The embodiment of FIG. 2 is particularly useful in compensating for beam offset errors arising within the guide where the exact position of the structural cause of the error is uncertain.

Figure 4:
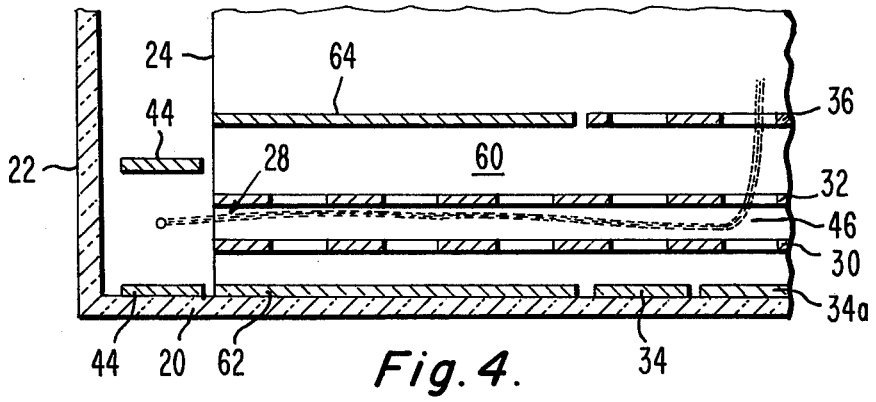
FIG. 4 is a sectional view similar to that of FIG. 2 of a different embodiment of the present invention.

With reference to FIG. 4, an alternate embodiment incorporates a phase delay region 60 into the grid guide structure 28 at the end of each of the guides adjacent to the cathode 40. The phasing region 60 differs from the remainder of the beam guide in that a pair of phasing electrodes 62 and 64 extend parallel to the beam guide 28 on the front and rear sides thereof. The first phasing electrode 62 is positioned on the rear wall 20 of the display in a similar manner to the extraction electrodes 34. The second phasing electrode 64 is between the second guide grid 32 and the screen 38.

Figure 5:
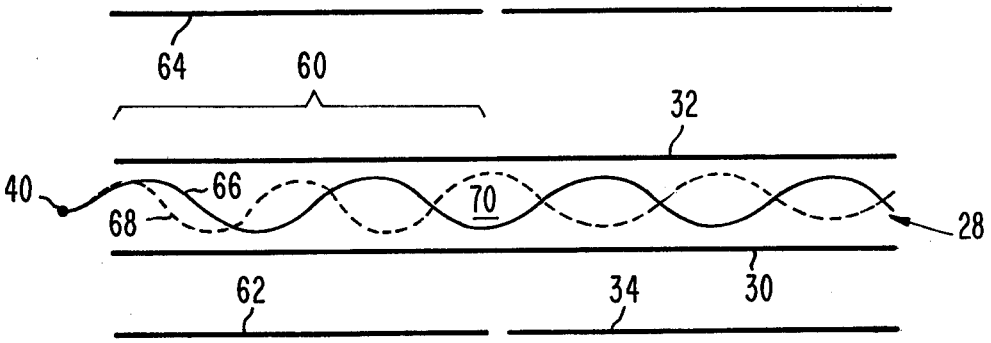
FIG. 5 is a diagrammatical representation of electron beam flow in the section of FIG. 4.

As shown in FIG. 5, the biasing potential on the two phasing electrodes 62 and 64 varies between two voltages levels which produce beam trajectories 66 and 68. The difference in the two voltage levels results in a 180° phase shift between the two beams 66 and 68 as they emerge from the delay region 60 at a point 70. The potential on the two guide grids 30 and 32 remain constant at all times so that the phase relationship between the various beam trajectories remains constant throughout the remainder of the beam guide 28. Therefore, in the remainder of the beam guide where extraction occurs, there will always be 180° phase difference between the beams produced by each of the phasing electrodes bias voltages. As in the example in FIGS. 2 and 3, the voltages on the phasing electrodes 62 and 64 may be alternated with every frame or field, twice every picture element dwell time, or at some other rate which allows effective averaging of the errors. In the second embodiment in FIGS. 4 and 5, a total compensation exists for the oscillation of the electron beam due to injection of the beam off of the geometric axis of the guide. However, the second embodiment does not compensate for pertubations in the beam due to misalignment of the apertures in the two guide grids 30 and 36 which occur in the beam guide 28 beyond the phase delay region 60. If such misalignments in the guide grids occur, they will affect both trajectories 66 and 68 in the same way and switching between the two trajectories will have no compensatory effect on the average beam landing error. Where the guide structure errors give rise to beam errors, continuous dephasing as in FIG. 2, is required in order to attenuate average landing errors.

I claim:

1. A method for compensating for electron beam oscillations in an electron beam guide comprising varying the electrical fields within the guide so as to alter the phase of the electron beam oscillations.

2. The method as in claim 1 in a beam guide comprising at least two guide electrodes between which the electron beam travels wherein the varying of the electrical field comprises changing the bias on the two guide electrodes.

3. The method as in claim 1 wherein the electrical fields are varied continuously.

4. The method as in claim 1 wherein the electrical fields are varied by alternately switching the electric fields to a series of discrete levels.

5. The method as in claim 1 wherein the electric fields are varied along the full length of the electron beam guide.

6. The method as in claim 1 wherein the electric fields are varied along only a portion of the length of the electron beam guide.

7. A method for reducing electron beam landing error in a guided beam image display device caused by oscillations of the beam in the beam guide, said method comprising varying the electrical fields within the guide to alter the phase of the electron beam oscillations.

8. The method as in claim 7 wherein the electric fields are changed once every image field.

9. The method as in claim 7 wherein the electric fields are changed once every image frame.

* * * * *